US007806092B2

(12) United States Patent
Kamiyama

(10) Patent No.: US 7,806,092 B2
(45) Date of Patent: Oct. 5, 2010

(54) DRIVE DEVICE MOUNTED IN VEHICLE BODY WHICH INCLUDES VARIABLE COMPRESSION RATIO INTERNAL COMBUSTION ENGINE

(75) Inventor: Eiichi Kamiyama, Mishima (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 397 days.

(21) Appl. No.: 11/860,129

(22) Filed: Sep. 24, 2007

(65) Prior Publication Data

US 2008/0178857 A1 Jul. 31, 2008

(30) Foreign Application Priority Data

Sep. 26, 2006 (JP) ..... 2006-260792

(51) Int. Cl.
*F02B 75/04* (2006.01)
*F01M 9/10* (2006.01)

(52) U.S. Cl. ..... 123/48 C; 123/78 C; 123/195 C

(58) Field of Classification Search ..... 123/48 R, 123/48 C, 78 R, 78 C, 90.38, 195 C, 198 E
See application file for complete search history.

(56) References Cited

U.S. PATENT DOCUMENTS 7,036,468 B2 * 5/2006 Kamiyama ..... 123/78 R
2007/0045030 A1 3/2007 Kamiyama et al.

FOREIGN PATENT DOCUMENTS

| | | |
|---|---|---|
| JP | 4-31010 | 5/1992 |
| JP | 5-203019 | 8/1993 |
| JP | 7-26981 | 1/1995 |
| JP | 2002-332913 | 11/2002 |
| JP | 2003-206771 | 7/2003 |
| WO | WO 2005/110792 A1 | 11/2005 |

* cited by examiner

*Primary Examiner*—Noah Kamen
(74) *Attorney, Agent, or Firm*—Oblon, Spivak, McClelland, Maier & Neustadt, L.L.P.

(57) ABSTRACT

A drive device includes a variable compression ratio internal combustion engine that moves a cylinder block relative to crankcase in a cylinder axis direction, and a transmission device. A chain case is made up of a crankcase-side chain case fixed to the crankcase, and a cylinder block-side chain case fixed to the cylinder block. An upper portion of the crankcase-side chain case is supported on a vehicle body via a support member. The transmission device is supported on the vehicle body via the support member. A support member coupling portion that fixes the support member of the crankcase-side chain case includes a rib that improves the rigidity of a front wall portion of the crankcase-side chain case.

14 Claims, 11 Drawing Sheets

DRIVE DEVICE MOUNTED IN VEHICLE BODY WHICH INCLUDES VARIABLE COMPRESSION RATIO INTERNAL COMBUSTION ENGINE

INCORPORATION BY REFERENCE

The disclosure of Japanese Patent Application No. JP-2006-260792 filed on Sep. 26, 2006 including the specification, drawings and abstract is incorporated herein by reference in its entirety.

BACKGROUND OF THE INVENTION

1. Field of the Invention

The invention relates to a drive device mounted in a vehicle body which includes a variable compression ratio internal combustion engine capable of changing the compression ratio.

2. Description of the Related Art

In the related art, there has been proposed a piston reciprocating type variable compression ratio internal combustion engine that changes the compression ratio by moving a cylinder block relative to a crankcase in the direction of an axis of a cylinder (hereinafter, referred to simply as "the up-down direction") (see, e.g., Japanese Patent Application Publication No. 2003-206771 (JP-A-2003-206771)).

Incidentally, a piston reciprocating type internal combustion engine has a chain mechanism for rotating a crankshaft and camshafts in a coordinated manner, and a chain case that covers the chain mechanism. The chain mechanism is provided on a front surface of an engine body (including the crankcase and the cylinder block) (i.e., a surface of the engine body opposite from a surface thereof to which a transmission device is coupled). The chain case is fixed to the engine body by bolts.

On the other hand, a drive device of a vehicle which includes an internal combustion engine and a transmission device is supported on a vehicle body at least two sites. For example, one of the two sites is the chain case that constitutes a front surface of the engine body, and the other site is the transmission device.

The chain case of the aforementioned variable compression ratio internal combustion engine is divided into a cylinder block-side chain case fixed to the cylinder block and a crankcase-side chain case fixed to the crankcase since the cylinder block and the crankcase are moved relative to each other. However, it has not been thoroughly considered how a drive device that includes a variable compression ratio internal combustion engine provided with divided chain cases and a transmission device is to be supported on a vehicle body.

SUMMARY OF THE INVENTION

A drive device mounted in a vehicle body in accordance with a first aspect of the invention includes a transmission device, and a variable compression ratio internal combustion engine that includes a crankcase that rotatably supports a crankshaft coupled to the transmission device, and a cylinder block disposed above the crankcase, and that is capable of changing a compression ratio by moving the cylinder block relative to the crankcase in a cylinder axis direction.

This drive device includes a support member whose portion is supported on the vehicle body in order to support the drive device on the vehicle body, a cylinder block-side chain case fixed to the cylinder block so as to cover a front surface of the cylinder block that is a surface opposite from a side of the cylinder block where the transmission device is disposed, and a crankcase-side chain case which is fixed to the crankcase so as to cover a front surface of the crankcase that is a surface opposite from a side of the crankcase where the transmission device disposed, and which has a support member coupling portion that couples to another portion of the support member.

In the drive device of this aspect, the chain case is made up of the cylinder block-side chain case and the crankcase-side chain case. Furthermore, a portion of the support member (e.g., an engine mount bracket) is supported on the vehicle body, and another portion of the support member is coupled to the crankcase-side chain case by the support member coupling portion. Therefore, when the compression ratio of the internal combustion engine is changed, the cylinder block, which is relatively light in weight, is moved in the up-down direction relative to the crankcase and a structure body coupled to the crankcase, which are heavy in weight and are supported on or fixed to the vehicle body. As a result, the energy needed in order to change the compression ratio can be reduced.

If a construction in which the cylinder block is supported on the vehicle body and the crankcase is suspended from the cylinder block is adopted, it becomes necessary to lift the crankcase and the structure bodies coupled to the crankcase which are heavy in weight, when the compression ratio is to be raised; therefore, there arises possibility of the compression ratio-changing mechanism being increased in size. In contrast, according to the foregoing construction, since the whole internal combustion engine (i.e., the cylinder block and the crankcase) is supported on the vehicle body by supporting the crankcase located below the cylinder block on the vehicle body via the support member, size increase of the compression ratio-changing mechanism can be avoided.

In the drive device, the crankcase-side chain case may have a side wall portion that contacts a vicinity of a left-side end portion of the front surface of the crankcase and a vicinity of a right-side end portion of the front surface of the crankcase and that extends in a direction orthogonal to the front surface of the crankcase, and a front wall portion that is contiguous to the side wall portion and that faces the front surface of the crankcase, and the support member coupling portion may include a support member fixture portion which another portion of the support member is in contact with and is fixed to, and a rib that extends from the support member fixture portion and that is contiguous to the front wall portion so as to improve a rigidity of the front wall portion.

In the instance where a support member coupling portion is provided on the crankcase-side chain case as in the drive device of the foregoing aspect, it sometimes happens that a great force from the vehicle body through the support member (in particular, a component force along the direction orthogonal to the front surface of the crankcase) is exerted on the crankcase-side chain case. Therefore, there is possibility of deformation of the front wall portion that constitutes the front surface portion of the crankcase-side chain case. However, in the foregoing construction, the front wall portion is reinforced by the rib of the support member coupling portion, so that deformation of the front wall portion can be prevented. As a result, for example, it becomes possible to avoid a problem of lubricating oil leaking from the chain case.

In this instance, the rib may be formed so as to extend from the support member fixture portion to a portion of the side wall portion. The portion of the side wall portion that the rib extends to (the rib reaches) is, for example, a portion of an end portion of the side wall portion that is opposite from a portion of the side wall portion that is in contact with the crankcase.

According to this construction, the great force exerted on the support member fixture portion in the direction orthogonal to the front surface of the crankcase is transmitted to the portion of the side wall portion through the rib. On the other hand, the side wall portion is in contact with the front surface of the crankcase, and extends in the direction orthogonal to the front surface of the crankcase. Therefore, the side wall portion does not deform under the great force in the direction orthogonal to the front surface of the crankcase, but transmits the force to the front surface of the crankcase. As a result, it becomes possible to prevent deformation of the crankcase-side chain case (in particular, the front wall portion), and it becomes possible to avoid occurrence of a problem of, for example, lubricating oil leaking from the chain case.

In the foregoing aspect, a first bolt-purpose seat surface for fixing the crankcase-side chain case and the crankcase to each other may be formed in a portion of the side wall portion that extends from a rib-reach region that is a region in the side wall portion in which the rib reaches the side wall portion, in the direction orthogonal to the front surface of the crankcase, and that contacts the front surface of the crankcase.

According to this construction, the great force exerted on the support member fixture portion in the direction orthogonal to the front surface of the crankcase is more reliably transmitted to the front surface of the crankcase by the rib, the side wall portion and the first bolt. As a result, deformation of the front wall portion of the crankcase-side chain case can be more reliably prevented. In this instance, if the support member fixture portion is disposed above an upper end of the side wall portion, a more remarkable effect of preventing deformation of the front wall surface can be achieved. This can be explained as follows. That is, in a vicinity of the upper end of the side wall portion and the front wall portion contiguous to the vicinity of the upper end of the side wall portion (hereinafter, referred to as "the side wall upper end-adjacent portion" for the sake of convenience), the rigidity is relatively small. Besides, provided that a fixed moment load M is input, the force F (load) exerted on the side wall upper end-adjacent portion becomes smaller (follows $M=F \cdot x$) the longer the distance x to the side wall upper end-adjacent portion from a point at which the crankcase-side chain case is supported on the vehicle body via the support member.

In this instance, a second bolt-purpose seat surface for fixing the crankcase-side chain case and the crankcase to each other may be formed in another portion of the side wall portion that extends from a rib non-reach region that is another region in the side wall portion in which the rib does not reach the side wall portion, in the direction orthogonal to the front surface of the crankcase, and a diameter of a second bolt that uses the second bolt-purpose seat surface may be smaller than a diameter of a first bolt that uses the first bolt-purpose seat surface.

According to this construction, the crankcase-side chain case and the crankcase are fastened to each other with the large-diameter bolt being used for the portion to which the great force input to the crankcase-side chain case via the support member is transmitted, and with the small-diameter second bolt being used for a portion to which the great force is not transmitted. As a result, it becomes possible to set the rigidity, the fastening force, etc., in the fastening sites between the crankcase-side chain case and the crankcase at necessary values while reducing the number of the large-diameter bolts (heavy in weight). Therefore, the weight of the internal combustion engine can be reduced.

Furthermore, in the instance where the crankcase-side chain case includes the rib, at least a portion of the rib may include an extended-out portion that is extended out so as to contact the front surface of the crankcase, and a third bolt-purpose seat surface for fixing the crankcase-side chain case and the crankcase to each other may be formed in the extended-out portion.

According to this construction, the great force exerted on the crankcase-side chain case through the support member in the direction orthogonal to the front surface of the crankcase can be transmitted to the front surface of the crankcase through the rib, the extended-out portion extending out from the rib, and the third bolt. As a result, deformation of the crankcase-side chain case (in particular, of the front wall portion) can be more reliably prevented.

In this instance, it is desirable that a diameter of a third bolt that uses the third bolt-purpose seat surface be larger than a diameter of the second bolt that uses the second bolt-purpose seat surface. As a result, large-diameter bolts are used only at the sites where great force is exerted, so that the rigidity, the fastening force, etc., at the fastening sites between the crankcase-side chain case and the crankcase can be set at necessary values, and increase of the weight of the internal combustion engine can be restrained.

In addition, in any of the foregoing constructions of the drive device, the portion of the support member that is supported on the vehicle body may be supported on the vehicle body at a first position that is above an upper end of the crankcase, and the transmission device may be supported on the vehicle body at a second position, and the first position may be set at such a position that a center of gravity of a structure body of the drive device that excludes a structure body that moves together with the cylinder block when the compression ratio is changed may be below a straight line that connects the first position and the second position.

According to this construction, the center of gravity of the structure body (that includes mainly the crankcase and the transmission device, and that will be referred to as "non-mobile portion) of the drive device that excludes the structure body that moves together with the cylinder block when the compression ratio is changed is located below the straight line that connects the first position and the second position (i.e., the mount axis). Therefore, the non-mobile portion can be more stably supported than in the instance where the center of gravity of the non-mobile portion, which is heavy in weight, is above the mount axis, so that the whole drive device that includes the cylinder block, which is a movable portion for changing the compression ratio, can be more stably supported. As a result, since the force exerted on the crankcase-side chain case from the vehicle body can be reduced, deformation of the crankcase-side chain case can be restrained. Besides, since the first position is determined in this manner, it becomes possible to cause the mount axis to coincide with the principal axis of inertia. As a result, it becomes possible to support the drive device while maintaining the effect of reducing the vibration transmitted from the drive device to the vehicle body.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE EMBODIMENTS

Figure 1:
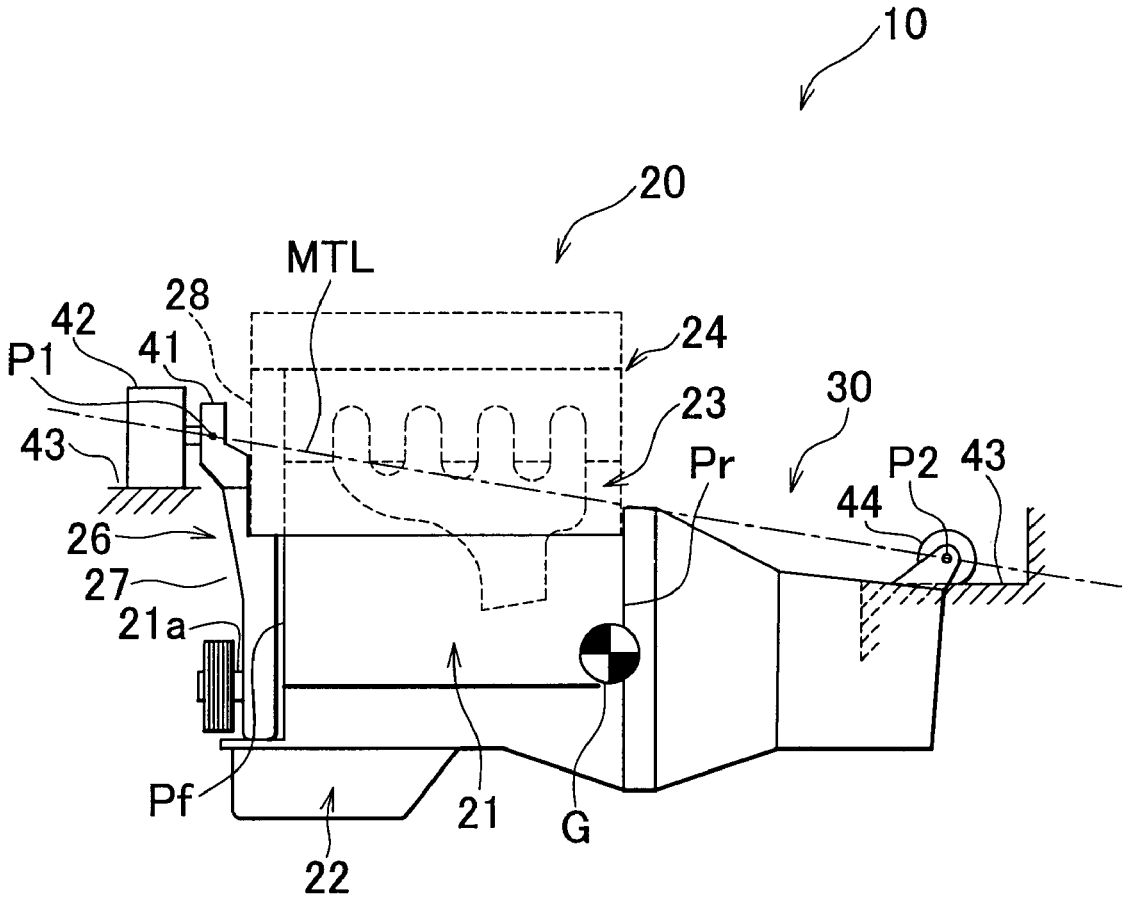
FIG. 1 is a schematic side view of a drive device in accordance with an embodiment of the invention.

Hereinafter, embodiments of a drive device (a support structure of a drive device) that includes a variable compression ratio internal combustion engine and a transmission device in accordance with the invention will be described with reference to the drawings. A drive device 10 is mounted in a front engine front wheel drive type vehicle. The drive device 10, as shown in FIG. 1, includes a variable compression ratio internal combustion engine (hereinafter, sometimes referred to simply as internal combustion engine" of "engine") 20, and a transmission device 30. In this specification, to simplify the description of the internal combustion engine 20 and the transmission device 30, the description and illustration of some of the component elements thereof is omitted.

The internal combustion engine 20 includes a crankcase 21, an oil pan 22, a cylinder block 23, and a cylinder head portion 24.

The crankcase 21 rotatably supports a crankshaft 21*a*. The crankshaft 21*a* is coupled to the transmission device 30 so as to be able to transmit power to the transmission device 30. Hereinafter, a surface Pr of the crankcase 21 that is on the side on which the transmission device 30 is disposed will be termed the rear surface Pr of the crankcase 21, and a surface Pf of the crankcase 21 opposite from the rear surface will be termed the front surface Pf of the crankcase 21. These terms apply to the cylinder block 23 in the same manner.

The oil pan 22 is fixed to the crankcase 21 at a location that is below or downward relative to the crankcase 21 (fixed to a lower portion of the crankcase 21). Herein, the term "downward" means a direction from a given point on the drive device 10 toward the ground surface when the drive device 10 is mounted in a vehicle body. Therefore, the term "upward" means a direction from a given point on the drive device 10 toward the sky. The oil pan 22, together with the crankcase 21, defines a space in which the crankshaft 21*a*, a lubricating oil, etc., are housed.

Figure 2:
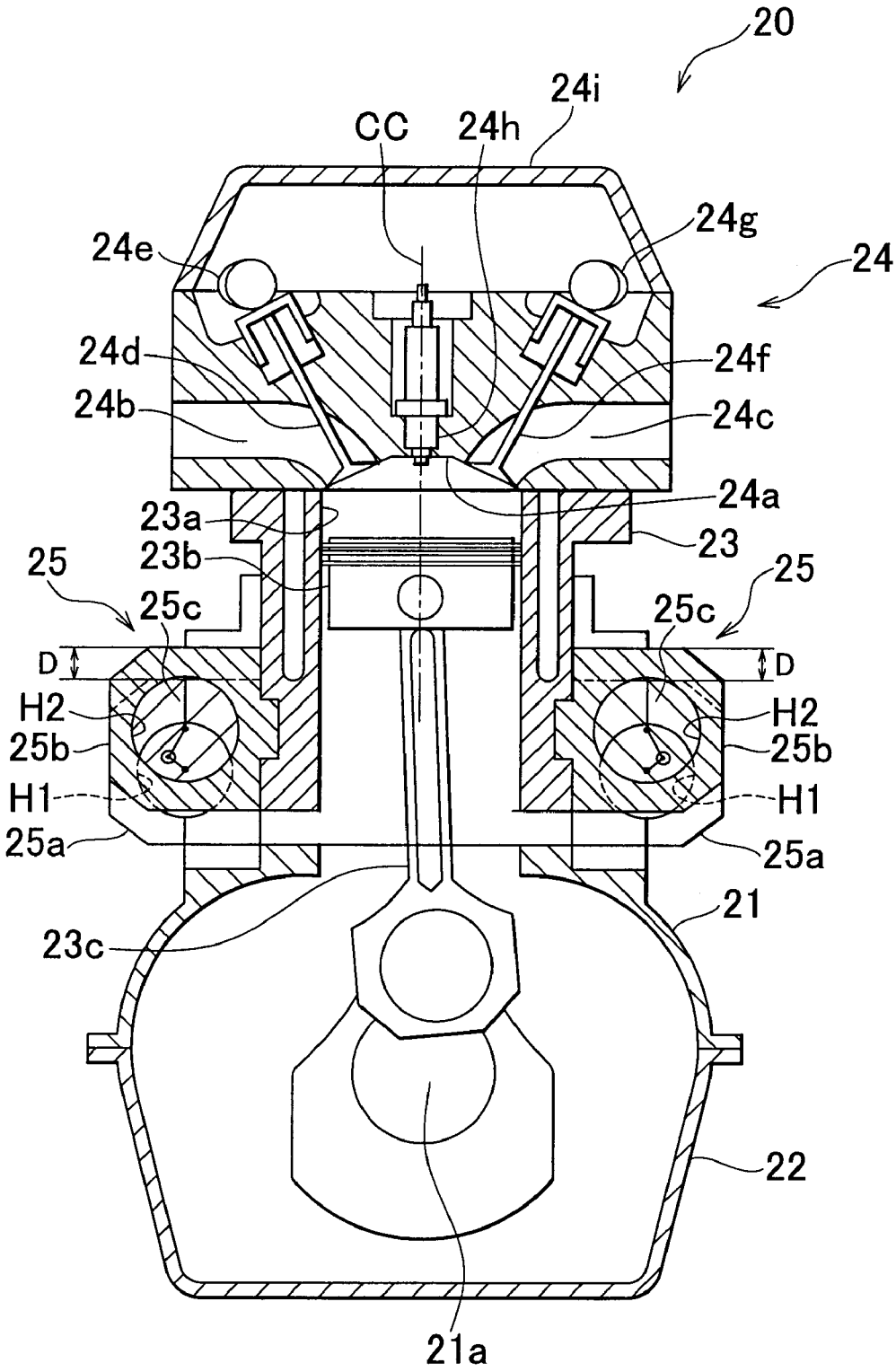
FIG. 2 is a sectional view of the internal combustion engine shown in FIG. 1 which is taken on a plane that is orthogonal to a plane containing a cylinder arrangement direction and that passes through a center axis of one of the cylinders.

The cylinder block 23 is disposed at a location that is upward relative to the crankcase 21. The cylinder block 23 includes a plurality of hollow cylindrical cylinders (cylinder bores) 23*a* (e.g., four cylinders) that are arranged in line in a longitudinal direction of the cylinder block, as shown in FIG. 2, which is a sectional view of the internal combustion engine 20, and FIG. 3, which is an exploded partial perspective view of the internal combustion engine 20, and FIG. 4, which is a perspective view of the cylinder block 23. That is, the axes CC of the cylinders 23*a* are positioned so as to intersect with a straight line that extends in the longitudinal direction of the cylinder block 23 (a straight line orthogonal to the front surface Pf of the cylinder block 23). Each cylinder 23*a* houses a generally cylindrical piston 23*b* as shown in FIG. 2. The pistons 23*b* are coupled to the crankshaft 21*a* via connecting rods 23*c*. The cylinder block 23 is constructed so that the compression ratio can be changed by moving the cylinder block 23 relative to the crankcase 21 in the direction of the axes CC of the cylinders 23*a*, as described below.

The cylinder head portion 24, is disposed above the cylinder block 23, and is fixed to the cylinder block 23, as shown in FIGS. 1 and 2. The cylinder head portion 24, as shown in FIG. 2, has a cylinder head lower surface 24*a* that partially defines a combustion chamber, an intake port 24*b* that communicates with the combustion chamber, and an exhaust port 24*c* that communicates with the combustion chamber, for each cylinder. Furthermore, the cylinder head portion 24 houses intake valves 24*d* that open and close the intake ports 24*b*, an intake camshaft 24*e* that drives the intake valves 24*d*, exhaust valves 24*f* that open and close the exhaust ports 24*c*, an exhaust camshaft 24*g* that drives the exhaust valves 24*f*, and ignition plugs 24*h*, etc. A head cover 24*i* is fixed to an upper portion of the cylinder head portion 24.

As shown in FIG. 2, the internal combustion engine 20 has a compression ratio-changing mechanism 25 for changing the compression ratio. This compression ratio-changing mechanism 25 is substantially the same as the mechanism disclosed in Japanese Patent Application Publication No. 2003-206771 (JP-A-2003-206771), which is aforementioned related-art. Therefore, the compression ratio-changing mechanism 25 will be briefly described with reference to FIGS. 2 to 4.

The compression ratio-changing mechanism 25 includes a case-side bearing-forming portion 25*a*, a block-side bearing-forming portion 25*b*, and a shaft-shaped drive portion 25*c*.

The case-side bearing-forming portion 25*a* is constructed of a plurality of first bearing-forming portions 25*a*1 and a plurality of second bearing-forming portions 25*a*2.

The first bearing-forming portions 25*a*1 are formed in a vertical wall portion near an upper end portion of each of left and right side walls of the crankcase 21. Each first bearing-forming portion 25*a*1 has a semicircular recess portion. Each semicircular recess portion is formed at a position that corresponds to a position between adjacent cylinders 23*a* when the cylinder block 23 is disposed in an upper portion of the crankcase 21. Bolt holes are formed above and below each recess portion. Incidentally, in this specification, a bolt being formed and a bolt-purpose seat surface being formed mean substantially the same.

Vertically elongated holes 25*a*3 are formed between adjacent first bearing-forming portions 25*a*1 in each of the two vertical wall portions so that each vertically elongated hole 25*a*3 extends through the vertical wall portion. That is, the vertically elongated holes 25*a*3 are formed in regions in the left and right side walls of the crankcase 21 which include intersecting portions between the left and right side walls and straight lines that intersect with the axes CC of the cylinders 23*a* and that are orthogonal to the plane that passes through the axes CC of the cylinders 23*a* (cylinder axes-arrangement plane), in a state where the cylinder block 23 is disposed on the crankcase 21.

Each second bearing-forming portion 25*a*2 is a cap that is bolted to a corresponding one of the first bearing-forming portions 25*a*1. Each second bearing-forming portion 25*a*2 has a semicircular recess portion that is equal in diameter to the semicircular recess portions of the first bearing-forming portions 25*a*1.

Each second bearing-forming portion 25*a*2 is fixed to a corresponding one of the first bearing-forming portions 25*a*1 via bolts inserted into the aforementioned bolt holes so that the semicircular recess portion of the first bearing-forming portion 25*a*1 and the semicircular recess portion of the second bearing-forming portion 25*a*2 face each other. As a result, a plurality of cylindrical bearing holes (cam housing holes) H1 shown in FIG. 2 are formed. The center axes of the bearing holes H1 on each of the left and right sides are aligned on a single straight line. The axis of the bearing holes H1 on each side extends parallel to the arrangement direction of the cylinders 23*a* (a straight line that intersects orthogonally with the axes CC of the cylinders 23*a*), in a state in which the cylinder block 23 is disposed in an upper portion of the crankcase 21.

Figure 3:
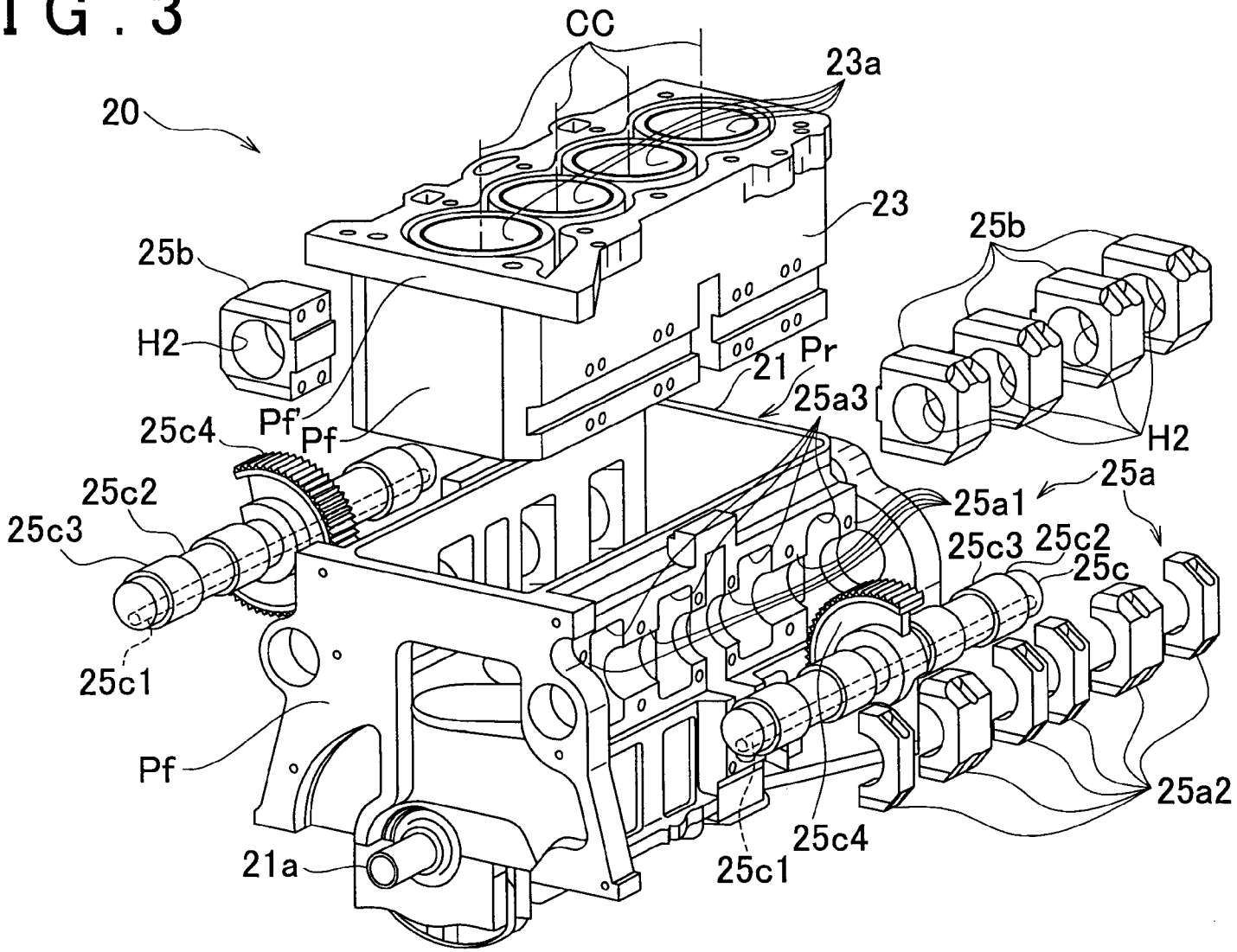
FIG. 3 is an exploded partial perspective view of the internal combustion engine shown in FIG. 1.
Figure 4:
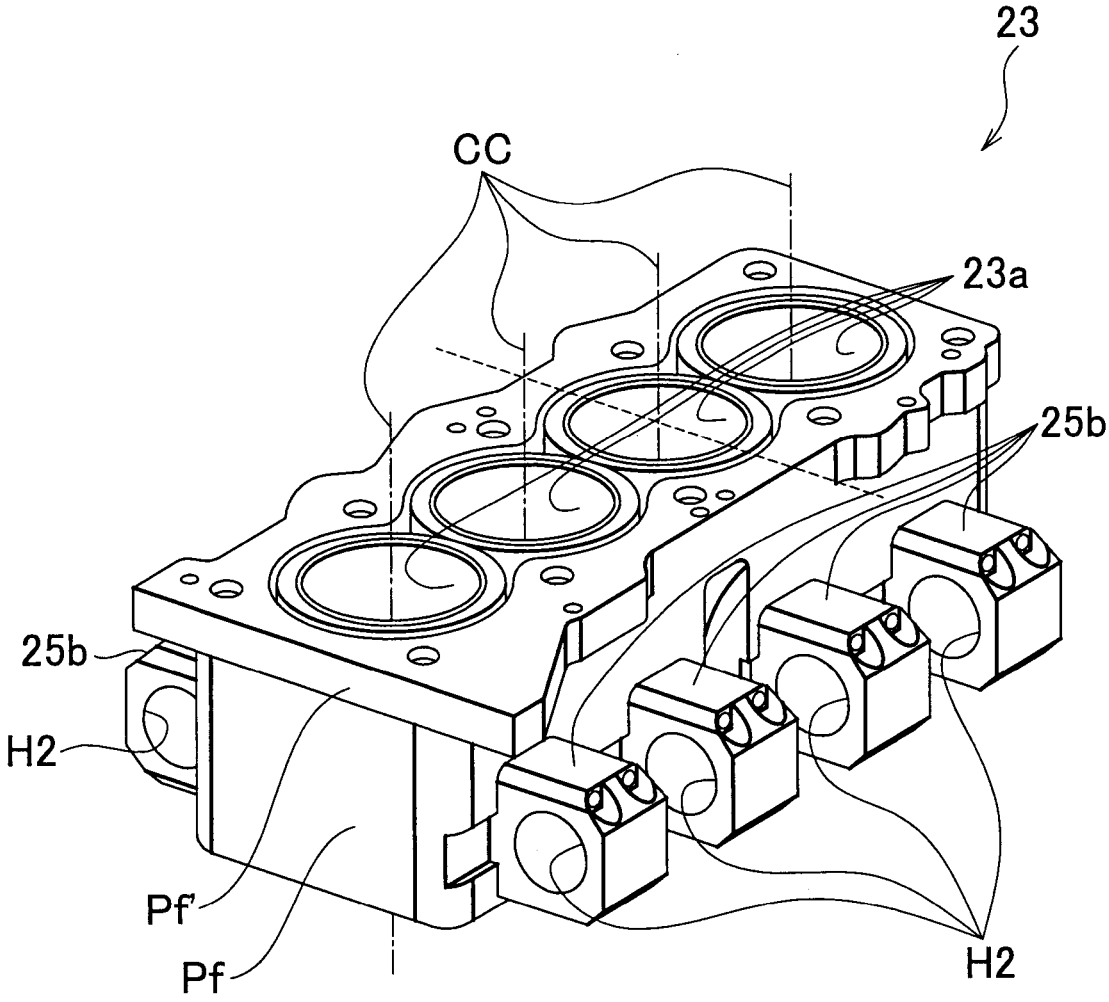
FIG. 4 is a perspective view of a cylinder block shown in FIG. 1.

Each block-side bearing-forming portion 25*b* is a generally rectangular parallelepiped as shown in FIGS. 2 to 4, and has a cylindrical bearing hole H2. Each block-side bearing-forming portion 25*b* is housed in a corresponding one of the vertically elongated holes 25*a*3 formed in the vertical wall portions of the crankcase 21, and is bolted to a corresponding portion of the left or right side wall portion of the cylinder block 23 which is near a crankcase 21-side end portion of the cylinder block 23 (a lower end portion of the cylinder block 23), in a state where the cylinder block 23 is disposed in an upper portion of the crankcase 21. In this construction, the bearing holes H1 and the bearing holes H2 are alternately aligned along the arrangement direction of the cylinders 23*a*.

The length of the vertically elongated holes 25*a*3 in the direction of the cylinder axes CC is set longer than the length of the block-side bearing-forming portions 25*b* fixed to the cylinder block 23 which is measured in the direction of the cylinder axes CC. Thus, the block-side bearing-forming portions 25*b* are movable integrally with the cylinder block 23 in the direction of the cylinder axes CC relative to the crankcase 21.

When all the block-side bearing-forming portions 25*b* have been fixed to the cylinder block 23, the center axes of the bearing holes H2 of the block-side bearing-forming portions 25*b* on each of the left and right sides are aligned on a single straight line. The axis of the bearing holes H2 on each side extends parallel to the arrangement direction of the cylinders 23*a*. The distance between the axes of the bearing holes H2 formed at the left and right side wall portions of the cylinder block 23 is the same as the distance between the axes of the bearing holes H1 formed at the left and right sides of the crankcase 21.

On the other hand, the shaft-shaped drive portion 25*c* is inserted through the bearing holes H1 and the bearing holes H2 on each side. As shown in FIG. 3 and FIGS. 5A to 5C, which are sectional views of one of the shaft-shaped drive portions 25*c*, each shaft-shaped drive portion 25*c* has a small-diameter shaft portions 25*c*1, fixed cylindrical portions 25*c*2 fixed to the shaft portions 25*c*1 while being eccentric to the center axis of the shaft portions 25*c*1, and rotary cylindrical portions 25*c*3 attached rotatably to the shaft portions 25*c*1 while being eccentric to the center axis of the shaft portions 25*c*1.

The fixed cylindrical portions 25*c*2 are cylindrical members that are larger in diameter than the shaft portions 25*c*1, and have the same perfect circular cam profile as the bearing holes H1. The fixed cylindrical portions 25*c*2 are housed in the bearing holes H1 that are formed in the case-side bearing-forming portions 25*a* of the crankcase 21. The fixed cylindrical portions 25*c*2 are constructed so as to rotate about the center axis thereof while being in contact with the wall surface of the bearing holes H1.

The rotary cylindrical portions 25*c*3 are cylindrical members that are larger in diameter than the shaft portions 25*c*1 and the fixed cylindrical portions 25*c*2, and have the same perfect circular cam profile as the bearing holes H2. The rotary cylindrical portions 25*c*3 are housed in the bearing holes H2 that are formed in the block-side bearing-forming portions 25*b* fixed to the cylinder block 23. Each of the rotary cylindrical portions 25*c*3 is constructed so as to rotate in contact with the wall surface of a corresponding one of the bearing holes H2. Incidentally, the left and right shaft-shaped drive portions 25*c*, the left and right bearing holes H1, and the left and right bearing holes H2 have a mirror image relationship with each other with respect to the plane that passes through the cylinder axes CC.

Furthermore, each of the shaft-shaped drive portions 25*c* has a gear 25*c*4 near a center position on the shaft-shaped drive portion 25*c* in the direction of the axis thereof. The gear 25*c*4 is fixed so as to be eccentric to the center axis of the shaft portion 25*c*1, and be coaxial with the fixed cylindrical portions 25*c*2 (therefore, coaxial with the bearing holes H1). That is, the center axis of rotation of the gear 25*c*4 coincides with the center axis of the fixed cylindrical portions 25*c*2. Each of the two gears 25*c*4 on both sides in mesh with a corresponding one of two worm gears (not shown). The worm gears are attached to an output shaft of a motor (not shown) that is fixed to the crankcase 21. The two worm gears have spiral grooves that are opposite in the rotation direction to each other. Therefore, when the motor is rotated, the two shaft-shaped drive portions 25*c* rotate about the center axes of the their fixed cylindrical portions 25*c*2 in directions opposite to each other.

Figure 5A:
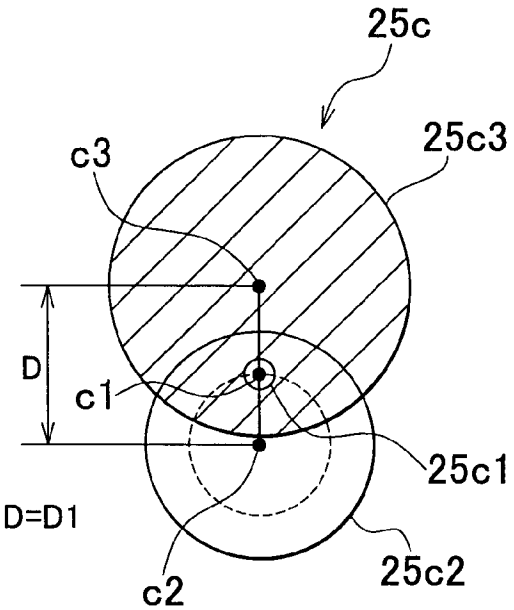
FIGS. 5A, 5B and 5C are diagrams for describing an operation of a compression ratio-changing mechanism provided for the internal combustion engine shown in FIG. 1.
Figure 5B:
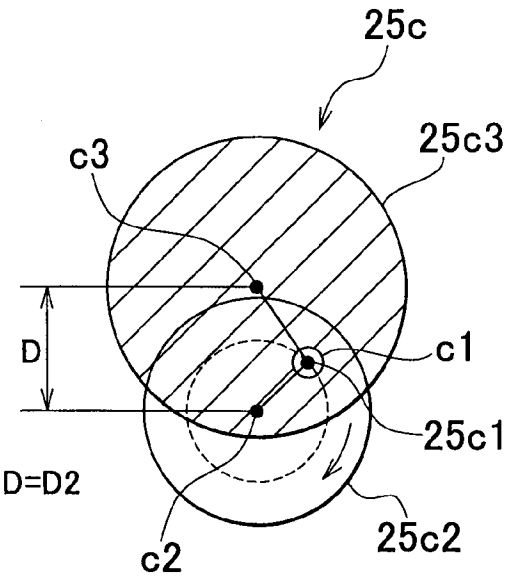
Figure 5C:
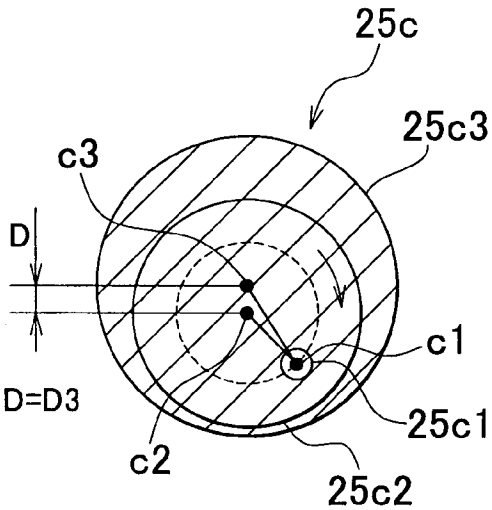

FIGS. 5A, 5B and 5C are diagrams conceptually showing motion of the shaft-shaped drive portion 25*c* that is located on the right side of the crankcase 21 and the cylinder block 23 when viewed from the side of the front surfaces Pf thereof. For example, when, as shown in FIG. 5A, the center c2 of the fixed cylindrical portions 25*c*2, the center c1 of the shaft portions 25*c*1, and the center c3 of the rotary cylindrical portions 25*c*3 are positioned on a straight line in this order, the distance D between the crankcase 21 (the center of the bearing holes H1) and the cylinder block 23 (the center of the bearing holes H2) becomes equal to a distance D1, which is the maximum distance. Therefore, the volume of the combustion chamber occurring when the piston 23*b* is at the top dead center position is large. As a result, the compression ratio of the internal combustion engine 20 is low.

If from the state shown in FIG. 5A, the motor is driven to rotate the fixed cylindrical portions 25*c*2 about the center axis of the fixed cylindrical portions 25*c*2, a state shown in FIG. 5B is assumed. At this time, the distance D is equal to the distance D2. Furthermore, if from the state shown in FIG. 5B, the motor is driven in the same rotation direction as mentioned above, the fixed cylindrical portions 25*c*2 rotate further about the center axis of the fixed cylindrical portions 25*c*2. At this time, the distance D is equal to the distance D3. The distance D3 is less than the distance D2 and the distance D2 is less than the distance D1. Therefore, the compression ratio during the state shown in FIG. 5B is higher than the compression ratio during the state shown in FIG. 5A, and the compression ratio during the state shown in FIG. 5C is higher than the compression ratio during the state shown in FIG. 5B. In this manner, the compression ratio is changed in the internal combustion engine 20.

Referring back to FIG. 1, the internal combustion engine 20 has a chain case 26. The chain case 26 is provided on the side of the front surfaces Pf of the crankcase 21 and the cylinder block 23 (i.e., the side of the front surface of the internal combustion engine 20), and covers a chain mechanism provided for rotating the crankshaft and the camshaft in coordination. The chain mechanism is supplied with lubricating oil from the front surface Pf of the crankcase 21 by a well-known mechanism (not shown).

Figure 6:
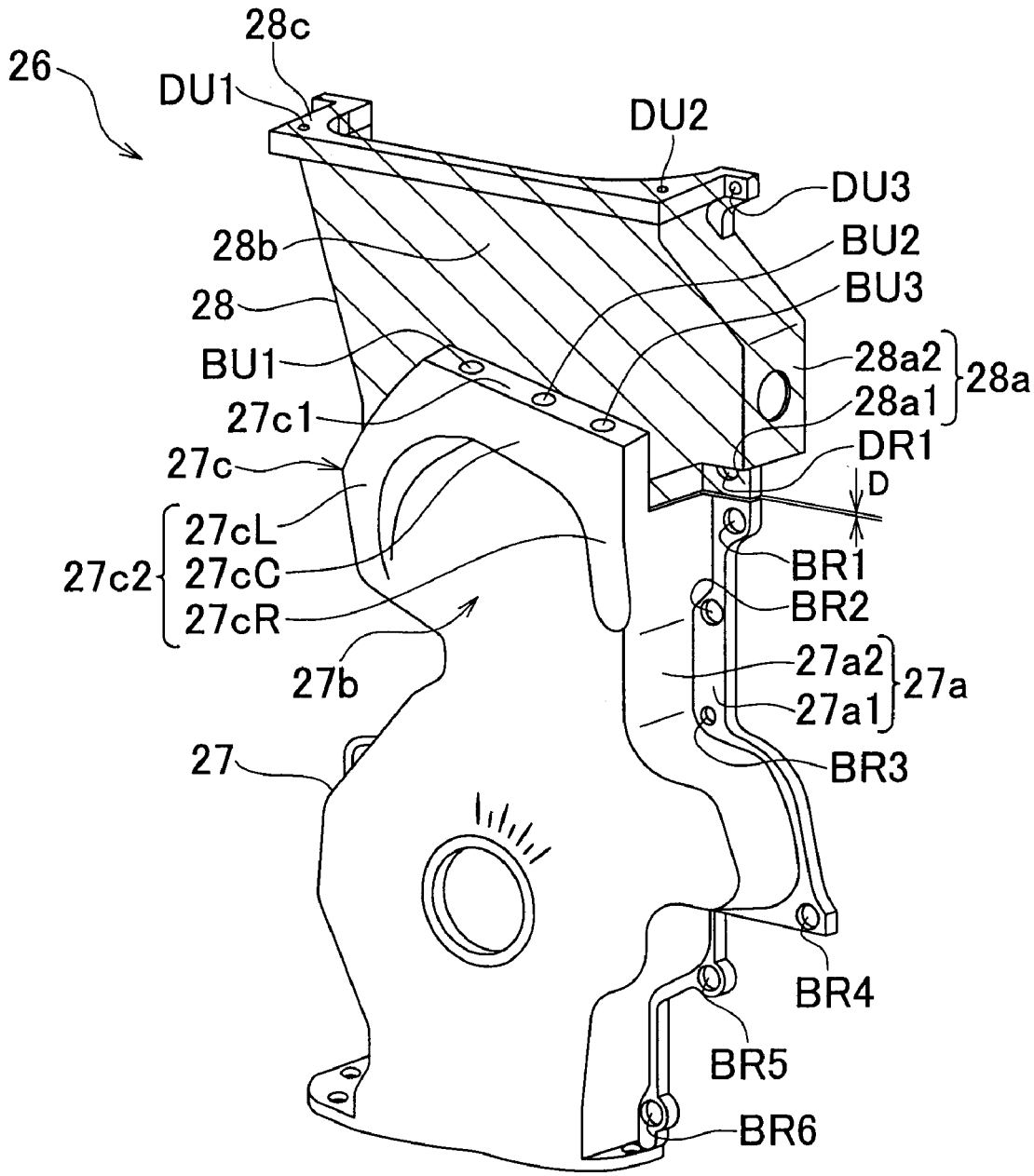
FIG. 6 is a perspective view of a chain case when the compression ratio of the internal combustion engine shown in FIG. 1 is the highest compression ratio.
Figure 7:
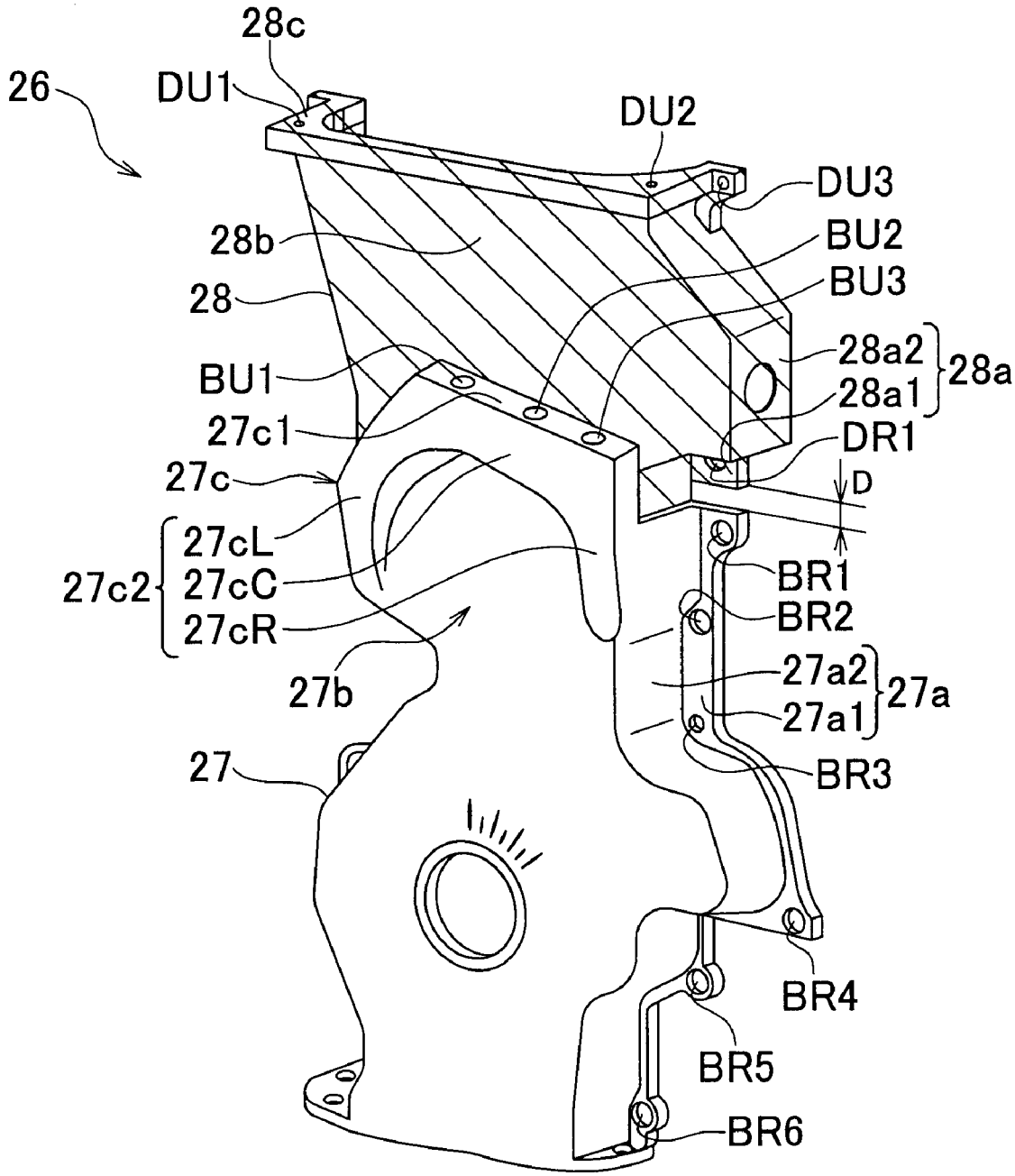
FIG. 7 is a perspective view of the chain case when the compression ratio of the internal combustion engine shown in FIG. 1 is the lowest compression ratio.

As shown in the perspective views of the chain case 26 in FIGS. 6 and 7, the chain case 26 is made up of a crankcase-side chain case (lower-side chain case) 27, and a cylinder block-side chain case (upper-side chain case) 28. Incidentally, in FIGS. 6 and 7, the cylinder block-side chain case 28 is marked with diagonal lines to facilitate distinction thereof. FIG. 6 shows an instance where the aforementioned distance D is set at the minimum distance, and therefore the compression ratio of the internal combustion engine 20 is set at a highest compression ratio. FIG. 7 shows an instance where the aforementioned distance D is set at a maximum distance, and therefore the compression ratio of the internal combustion engine 20 is set at a lowest compression ratio.

The crankcase-side chain case 27 has side wall portions 27*a*, a front wall portion 27*b*, and a support member coupling portion 27*c*. In this embodiment, these portions are integrally formed by casting.

The side wall portions 27*a* are made up of flanges 27*a*1 and side walls 27*a*2. The flanges 27*a*1 have a predetermined width, and are provided on left and right end portions of the crankcase-side chain case 27. Each flange 27*a*1 constitutes a portion provided for fixing the crankcase-side chain case 27 to the front surface Pf of the crankcase 21 (a forward wall of the crankcase 21 constituting the front surface Pf). The shapes of the outer peripheries of the flanges 27*a*1 located on the left and right sides of the crankcase-side chain case 27 are such as to extend along the left and right end portions of the front surface Pf of the crankcase 21. The flange 27*a*1 located on the right side of the crankcase-side chain case 27 has a plurality of bolt holes BR1 to BR6. The flange 27*a*1 located on the left side of the crankcase-side chain case 27, which is not shown in FIG. 6 or 7, also has a plurality of bolt holes BL1 to BL6 (not shown). When the crankcase-side chain case 27 is fixed to the front surface Pf of the crankcase 21, a plane defined by the flanges 27*a*1 becomes parallel to the front surface Pf of the crankcase 21, and the flanges 27*a*1 contact the front surface Pf of the crankcase 21.

Figure 8:
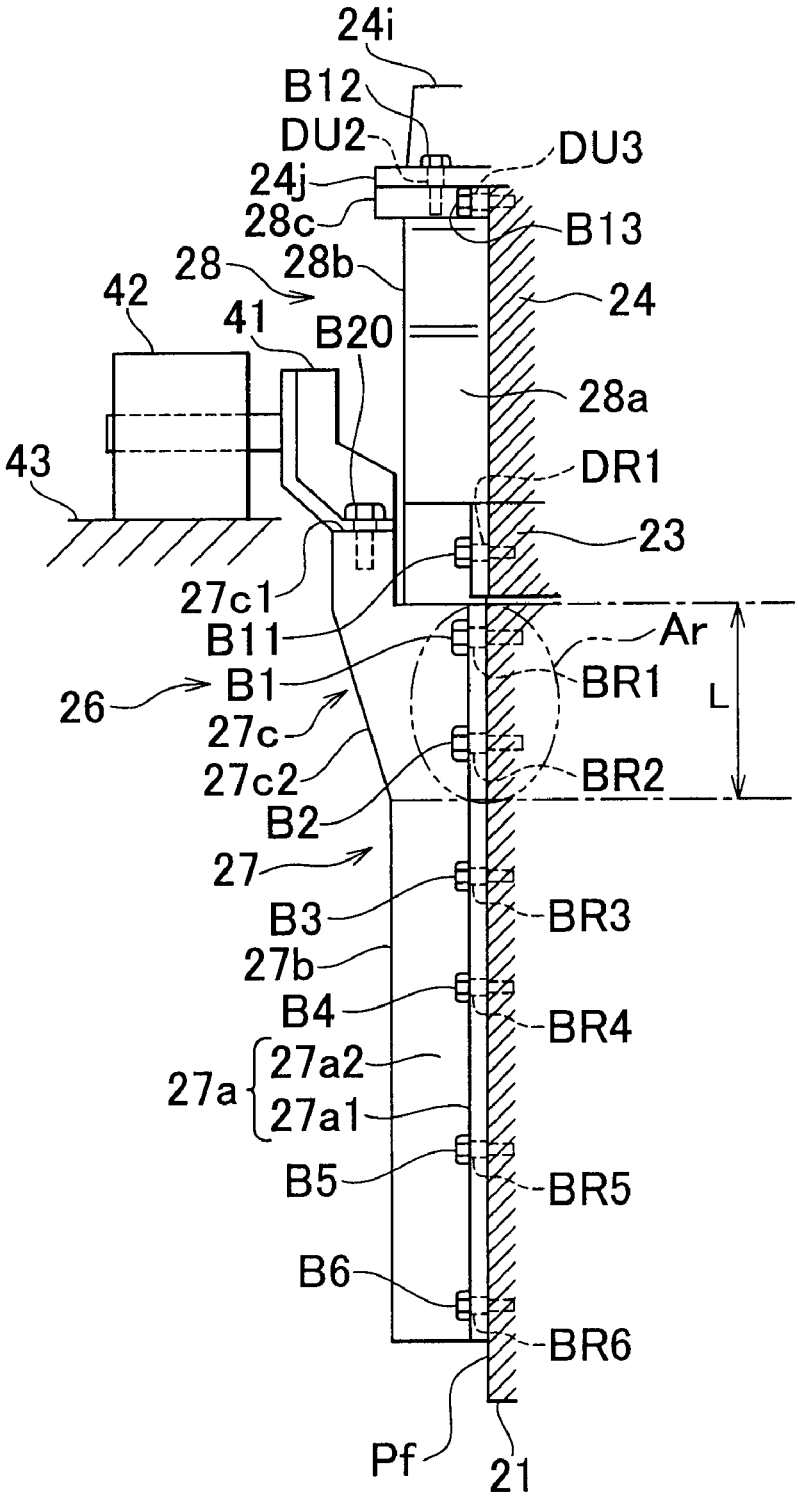
FIG. 8 is a side view of a crankcase-side chain case, a cylinder block-side chain case, and portions near the chain cases which are shown in FIG. 1.

The side walls 27*a*2 are platy portions that constitute the left and right side walls of the crankcase-side chain case 27. The side wall 27*a*2 located on the right side of the crankcase-side chain case 27 is contiguous to an inner periphery-side end portion of the flange 27*a*1 located on the right side of the crankcase-side chain case 27. Likewise, the side wall 27*a*2 located on the left side of the crankcase-side chain case 27 is contiguous with an inner periphery-side end portion of the flange 27*a*1 located on the left side of the crankcase-side chain case 27. The left and right side walls 27*a*2 extend (are provided so as to stand upright) from the front surface Pf of the crankcase 21 in a direction substantially orthogonal to the front surface Pf of the crankcase 21 when the crankcase-side chain case 27 is fixed to the front surface Pf of the crankcase 21. From the above description, it can be said that the side wall portions 27*a* located on the left and right sides of the crankcase 21 contact a left-side end-adjacent portion and a right-side end-adjacent portion, respectively, of the front surface Pf of the crankcase 21, and extend in a direction orthogonal to the front surface Pf of the crankcase 21. Upper ends of the left and right side walls 27*a*2 are formed so as to be located in substantially the same plane as an upper end surface of the crankcase 21 when the crankcase-side chain case 27 is fixed to the front surface Pf of the crankcase 21 as shown in FIG. 1, and FIG. 8, which will be described.

The front wall portion 27*b* is a platy portion (a substantially flat platy member in this embodiment) that constitutes a front surface wall of the crankcase-side chain case 27. The front wall portion 27*b* couples the side wall 27*a*2 located on the left side and the side wall 27*a*2 located on the right side. The plane defined by the front wall portion 27*b* faces and is substantially parallel to the front surface Pf of the crankcase 21 when the crankcase-side chain case 27 is fixed to the front surface Pf of the crankcase 21.

The support member coupling portion 27*c* has a support member fixture portion 27*c*1 and a rib 27*c*2. The support member fixture portion 27*c*1 is a portion that constitutes an upper wall (upper plane) of the support member coupling portion 27*c* when the crankcase-side chain case 27 is fixed to the front surface Pf of the crankcase 21. The support member fixture portion 27*c*1 is located above an upper end of the side wall portion 27*a*. Therefore, the support member fixture portion 27*c*1 is located above the upper end of the crankcase 21 when the crankcase-side chain case 27 is fixed to the front surface Pf of the crankcase 21. The support member fixture portion 27*c*1 has a plurality of (three in this embodiment) holt holes BU1 to BU3 for fixing an engine mount bracket (support member) 41 shown in FIGS. 1 and 8.

The rib 27*c*2 is made up of a middle portion 27*c*C that is contiguous to the support member fixture portion 27*c*1 and that extends in a substantially horizontal direction so as to be along the support member fixture portion 27*c*1 when the crankcase-side chain case 27 is fixed to the front surface Pf of the crankcase 21, a right-side leg portion 27*c*R that extends downward from a vicinity of a right end portion of the middle portion 27*c*C (i.e., a vicinity of a right end portion of the support member fixture portion 27*c*1), and a left-side leg portion 27*c*L that extends downward from a vicinity of a left end portion of the middle portion 27*c*C (i.e., a vicinity of a left end portion of the support member fixture portion 27*c*1). That is, the shape of the rib 27*c*2 is an inverted "U" shape (a shape of two legs joined) in a front view. The rib 27*c*2 is formed so as to extend from the support member fixture portion 27*c*1 to a portion (upper portion) of the side wall portion 27*a*, thus improving the rigidity of the front wall portion 27*b*. That is, the right leg portion 27*c*R and the left leg portion 27*c*L extend from the middle portion 27*c*C to upper portions of the side wall portions 27*a*. Therefore, the rib 27*c*2 is contiguous to the support member fixture portion 27*c*1, and extends to reach an end portion of each of the side wall portions 27*a* that is a portion (upper portion) of the side wall portion 27*a* and that is opposite from a portion of the side wall portion 27*a* that is in contact with the crankcase 21. Thus, the rib 27*c*2 constitutes a reinforcement portion that improves the rigidity of the front wall portion 27*b* against the force that is in the direction orthogonal to the front surface Pf of the crankcase 21 (prevents bending deformation of the front wall portion 27*b*.

The rib 27*c*2, as shown in FIG. 8, reaches a position that is a distance L downward from the upper end of the side wall portion 27*a*. For the sake of convenience, the region where the rib 27*c*2 reaches the side wall portion 27*a* (side wall 27*a*2) will be termed "rib reach region". Therefore, a region in the side wall portion 27*a* (side walls 27*a*2) where the rib 27*c*2 does not reach will be termed as "rib non-reach region".

As shown in FIGS. 6 to 8, a bolt hole BR1 and a bolt hole BR2 are formed in a portion of the right-side flange 27*a*1 (in a region Ar in FIG. 8) that is contiguous to the portion of the side wall 27*a*2 that extends from the aforementioned rib reach region in the direction orthogonal to the front surface Pf of the crankcase 21. A bolt hole BL1 and a bolt hole BL2 (not shown) are also formed at similar positions in the left-side flange 27*a*1.

Bolt holes BR3 to BR6 are formed in a portion of the right-side flange 27*a*1 (in a region other than the region Ar in FIG. 8) that is contiguous to a portion of the side wall 27*a*2 that extends from the aforementioned rib non-reach region in the direction orthogonal to the front surface Pf of the crankcase 21. Bolt holes BL3 to BL6 (not shown) are also formed at similar positions in the left-side flange 27*a*1.

The crankcase-side chain case 27 constructed as described above is bolted to the front surface Pf of the crankcase 21 as shown in FIG. 8, that is, by the bolts B1 to B6 inserted through the bolt holes BR1 to BR6 that are formed in the flange 27*a*1 located on the right side of the crankcase-side chain case 27, and is also bolted to the front surface Pf of the crankcase 21 by the bolts B1 to B6 inserted through the bolt holes BL1 to BL6 formed in the flange 27*a*1 (not shown) located on the left side of the crankcase-side chain case 27.

The bolt B1 used in the bolt hole BR1 (and the bolt hole BL1) and the bolt B2 used in the bolt hole BR2 (and the bolt hole BL2) are identical to each other. The bolt B1 and the bolt B2 are termed the first bolts, for the sake of convenience. The bolts B3 to B6 used in the other bolt holes BR3 to BR6 (and the bolt holes BL3 to BL6) are also identical to one another. The bolts B3 to B6 are termed the second bolts, for the sake of convenience. The diameter of the first bolts is larger than the diameter of the second bolts. For example, the diameter of the first bolt is 8 mm, whereas the diameter of the second bolt is 6 mm. In addition, a lower end portion of the crankcase-side chain case 27 has a flange in which an oil pan-fastening bolt hole is formed. The crankcase-side chain case 27 is fastened to the oil pan 22 by a bolt inserted through the oil pan-fastening bolt hole.

The cylinder block-side chain case 28 has platy side wall portions 28*a*, a front wall portion 28*b*, and an upper surface portion 28*c*.

Each side wall portion 28*a* is made up of a flange portion 28*a*1 and a side wall portion 28*a*2.

Each flange portion 28*a*1 is formed of a thin plate having a predetermined width and a predetermined thickness. Each flange portion 28*a*1 constitutes a portion for fixing the cylinder block-side chain case 28 to the front surface Pf side of the cylinder block 23 (in reality, to a forward wall Pf' located most forward on the cylinder block 23 which constitutes the front surface Pf). The flange portions 28*a*1 are provided on the left and right sides of a lower end portion of the cylinder block-side chain case 28. The outer peripheral shape of each of the left and right flange portions 28*a*1 is such as to extend along a corresponding one of the left and right end portions of a lower end portion of the front surface Pf of the cylinder block 23. The flange portion 28*a*1 located on the right side of the cylinder block-side chain case 28 has a bolt hole DR1. The flange portion 28*a*1 located on the left side of the cylinder block-side chain case 28 (which is not shown in any of FIGS. 6 to 8) also has a bolt hole DL1 (not shown). When the cylinder block-side chain case 28 is fixed to the front surface Pf side of the cylinder block 23, the plane defined by the flange portions 28*a*1 becomes parallel to the front surface Pf of the cylinder block 23, and the flange portions 28*a*1 contact the forward wall Pf' of the cylinder block 23.

The side wall portions 28*a*2 are platy portions that constitute side walls of the cylinder block-side chain case 28. A lower portion of the side wall portion 28*a*2 located on the right side of the cylinder block-side chain case 28 is contiguous to an inner periphery-side end portion of the flange portion 28*a*1 located on the right side of the cylinder block-side chain case 28. Likewise, a lower portion of the side wall portion 28*a*2 located on the left side of the cylinder block-side chain case 28 is contiguous to an inner periphery-side end portion of the flange portion 28*a*1 located on the left side of the cylinder block-side chain case 28. A lower portion of each of the left and right side wall portions 28*a*2 extends (is provided so as to stand upright) from the inner periphery-side end portion of the flange portion 28*a*1 in a direction substantially orthogonal to the front surface Pf of the cylinder block 23 when the cylinder block-side chain case 28 is fixed to the front surface Pf side of the cylinder block 23.

An upper portion of each of the left and right side wall portions 28*a*2 extends (is provided so as to stand upright) from a vicinity of a corresponding one of left and right outer periphery portions of the front surfaces Pf of the cylinder block 23 and the cylinder head portion 24 in a direction substantially orthogonal to the front surfaces Pf of the cylinder block 23 and the cylinder head portion 24, when the cylinder block-side chain case 28 is fixed to the front surface Pf side of the cylinder block 23. An upper end of each of the left and right side wall portions 28*a*2 is at a position that is slightly lower than the upper end surface of the cylinder head portion 24 when the cylinder block-side chain case 28 is fixed to the front surface Pf side of the cylinder block 23.

The front wall portion 28*b* is a platy portion that constitutes a front surface wall of the cylinder block-side chain case 28. The front wall portion 28*b* couples the side wall portion 28*a*2 located on the left side and the side wall portion 28*a*2 located on the right side. Therefore, the plane defined by the front wall portion 28*b* faces and is substantially parallel to the front surfaces Pf of the cylinder block 23 and the cylinder head portion 24 when the cylinder block-side chain case 28 is fixed to the front surface Pf of the cylinder block 23. An upper end of the front wall portion 28*b* is at a position that is slightly lower than the upper end surface of the cylinder head portion 24 when the cylinder block-side chain case 28 is fixed to the front surface Pf side of the cylinder block 23.

The upper surface portion 28*c* is a flange that is formed on the upper end portions of the platy side wall portions 28*a* and the front wall portion 28*b*. An upper flat surface of the upper surface portion 28*c* has a plurality of (two in this example) bolt holes DU1, DU2 for fixing the cylinder block-side chain case 28 and the cylinder head cover 24*i* to each other. In other words, the upper surface portion 28*c* is provided with a cylinder head cover coupling portion for coupling the upper surface portion 28*c* to the cylinder head cover 24*i*. Furthermore, left and right-end side flat surfaces (front surfaces) of the upper surface portion 28*c* have a plurality of (two in this embodiment) bolt holes DU3 and DU4 (DU4 being not shown in any of FIGS. 6 to 8) for fixing the cylinder block-side chain case 28 to the cylinder head portion 24.

The cylinder block-side chain case 28 constructed as described above is bolted to the forward wall Pf' of the cylinder block 23 as shown in FIG. 8, that is, by a bolt 11 inserted through the bolt hole DR1 formed in the flange portion 28*a*1 located on the right side of the cylinder block-side chain case 28, and is also bolted to the forward wall Pf' of the cylinder block 23 by a bolt B11 inserted through the bolt DL1 (not shown) formed in the flange portion 28*a*1 located on the left side of the cylinder block-side chain case 28.

Furthermore, the cylinder block-side chain case 28 is fixed to the cylinder head cover 24*i* by bolts B12 inserted into the bolt holes DU1, DU2 of the upper surface portion 28*c* and bolt holes formed in a flange 24*j* of the cylinder head cover 24*i*. Moreover, the cylinder block-side chain case 28 is bolted to the front surface Pf of the cylinder head portion 24 by bolts B13 inserted through the bolt hole DU (and the bolt hole DU4 (not shown)) of the upper surface portion 28*c*. The bolts B11 to B13 (the bolts that fix the cylinder block-side chain case 28 to the front surface Pf or the like of the cylinder block 23) are the aforementioned second bolts.

Figure 9A:
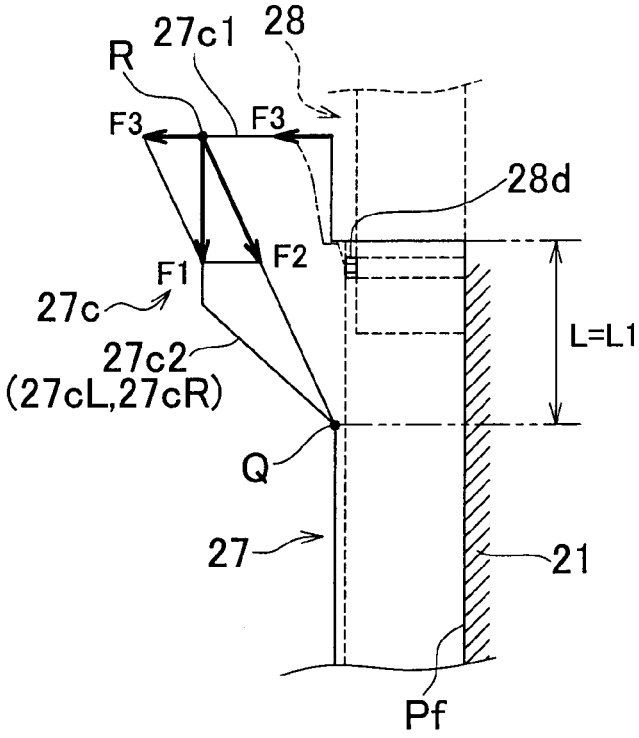
FIGS. 9A, 9B are conceptual diagrams for describing forces that act on the crankcase shown in FIG. 1.
Figure 9B:
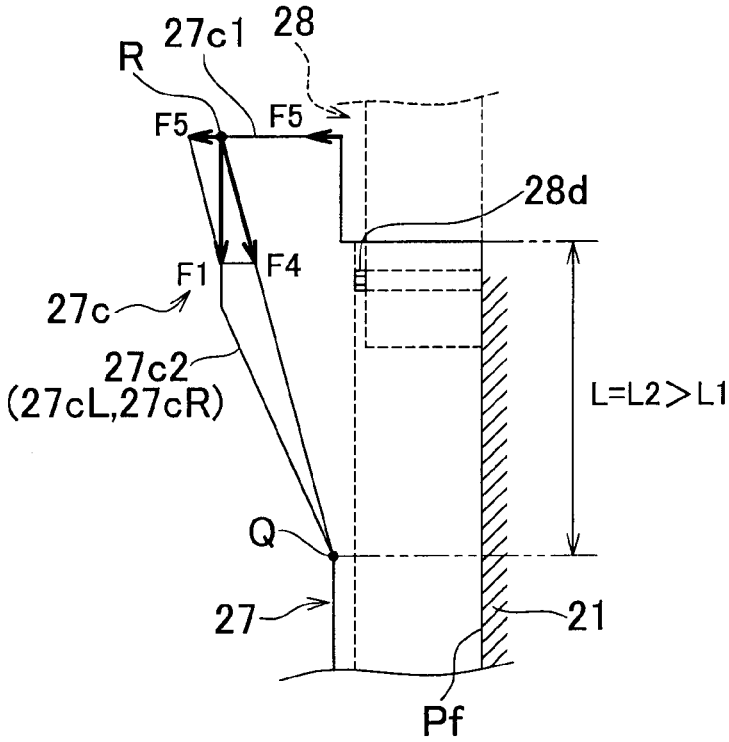

As shown in FIGS. 9A and 9B, a lower portion of the cylinder block-side chain case 28 enters the inside of the crankcase-side chain case 27 fixed to the front surface Pf of the crankcase 21 (a space defined by a reverse surface of the crankcase-side chain case 27, reverse surfaces of the side walls 27*a*, and the front surface Pf of the crankcase 21). A seal member 28*d* is disposed on and fixed to a lower portion of the cylinder block-side chain case 28. The seal member 28*d* seals a gap or the like between the cylinder block-side chain case 28 and the crankcase-side chain case 27. When the compression ratio is changed, the seal member 28*d* slides relative to the reverse surface of the front wall portion 27*b* and the reverse surfaces of the side walls 27*a* of the crankcase-side chain case 27 to maintain oil tightness of the interior of the chain case 26.

As shown in FIGS. 1 and 8, a portion of an engine mount bracket 41 is supported by an engine mount member (engine mount insulator) 42 that is fixed to a vehicle body 43. The engine mount member 42 includes a well-known vibration damper member that is made up of a liquid-tight member, an elastic member, etc. Other portions of the engine mount bracket 41 are fixed, as shown in FIGS. 6 to 8, to the support member fixture portion 27*c*1 by bolts B20 inserted into the bolt holes BU1 to BU3 formed in the support member fixture portion 27*c*1 of the crankcase-side chain case 27. As a result, the crankcase 21 is supported via the engine mount member 42, the engine mount bracket 41, and the crankcase-side chain case 27 in such a manner as to be suspended from the vehicle body 43.

The transmission device 30 is a device for changing the output torque of the internal combustion engine 20 to the rotating torque of wheels (not shown), and is made up of well-known structure bodies such as a transmission that includes a torque converter coupled to the crankshaft 21*a*, a differential gear, etc. The transmission device 30 is supported, as shown in FIG. 1, by a transmission device support member 44 in such a manner as to be suspended from the vehicle body 43. Therefore, the drive device 10 is supported at a point P1 (first position) shown in FIG. 1 by the vehicle body 43 via the engine mount bracket 41 and the engine mount member 42, and is also supported at a point P2 (second position) by the vehicle body 43 via the transmission device support member 44.

The point P1 and the point P2 are set so that a straight line connecting between the point P1 and the point P2 (hereinafter, referred to as "mount axis MTL") forms the principal axis of inertia of the drive device 10. The principal axis of inertia is a rotation axis that minimizes the inertia moment of the drive device 10. Therefore, even if vibration with its rotation center being on the mount axis MTL occurs due to rotation of the crankshaft 21*a* or the like involved in the operation of the internal combustion engine 20, the vibration of the vehicle caused by the vibration about the mount axis MTL is restrained since the mount axis MTL coincides with the principal axis of inertia.

The mount axis MTL is set so that the center of gravity G of a structure body made up of the crankcase 21, the oil pan 22, the crankcase-side chain case 27, the transmission device 30, etc. (i.e., a structure body obtained by excluding from the drive device 10 the structure bodies that are moved to change the compression ratio, that is, the cylinder block 23, the cylinder head portion 24, the cylinder block-side chain case 28, etc., which will be referred to as "non-mobile portion") is below the mount axis MTL.

Therefore, the non-mobile portion can be stably supported, and therefore the entire drive device 10 that includes the crankcase 21 can be stably supported, in comparison with the instance where the center of gravity of a non-mobile portion having a large weight is above the mount axis MTL. Besides, since the mount axis MTL coincides with the principal axis of inertia, the inertia moment of the non-mobile portion becomes large, so that the non-mobile portion can be more stably supported. Therefore, the internal combustion engine 20 that includes a structure body (i.e., the cylinder block 23, the cylinder head portion 24, etc.) provided in an upper portion of the non-mobile portion (which is therefore the drive device 10) can be stably supported. As a result, the force exerted from the vehicle body to the crankcase-side chain case 27 can be lessened, so that the deformation of the crankcase-side chain case 27 can be more effectively restrained.

As described above, the drive device 10 includes the support members 41, 42 that are partially supported on the vehicle body 43 in order to support the drive device 10 onto the vehicle body 43, the cylinder block-side chain case 28 which is fixed to the cylinder block 23 that is disposed above the crankcase 21 and that is moved in the direction of the cylinder axes CC, in such a manner that the cylinder block-side chain case 28 covers the front surface Pf of the cylinder block 23, and the crankcase-side chain case 27 that is fixed to the crankcase 21 so as to cover the front surface Pf of the crankcase 21 and that has the support member coupling portion 27*c* (a portion that includes the bolt holes BU1 to BU3) that couples other portions of the support members 41, 42.

Therefore, when the compression ratio of the internal combustion engine 20 is changed, the cylinder block 23 (and the cylinder head portion 24, and the like) that is comparatively light in weight is moved in the up-down direction relative to the comparatively heavy non-mobile portion that includes the crankcase 21 and the structure body (the transmission device 30, and the like) coupled to the crankcase and that is supported on or fixed to the vehicle body. As a result, the energy needed in order to change the compression ratio (e.g., the energy consumed by the motor that rotates the shaft-shaped drive portion 25*c* described above) can be reduced.

The crankcase-side chain case 27 has the side wall portions 27*a* that contact a vicinity of a left-side end portion and a vicinity of a right-side end portion of the front surface Pf of the crankcase 21 and that extend in a direction orthogonal to the front surface Pf of the crankcase 21, and the front wall portion 27*b* that is contiguous to the side wall portion 27*a* and that faces the front surface Pf of the crankcase 21. Furthermore, the support member coupling portion 27*c* includes the support member fixture portion 27*c*1 which another portion of the support member 41 contacts and is fixed to, and ribs 27*c*L, 27*c*R that extend from the support member fixture portion 27*c*1 and that are contiguous to the front wall portion 27*b* so as to improve the rigidity of the front wall portion 27*b* (in particular, the rigidly of the front wall portion 27*b* against the force acting in a direction orthogonal to the plane defined by the front wall portion 27*b*). Therefore, deformation of the front wall portion 27*b* can be prevented.

Furthermore, the ribs (ribs' leg portions) 27$c$L, 27$c$R are formed so as to extend from the support member fixture portion 27$c$1 to portions of the side wall portions 27$a$. Therefore, a great force (component force) exerted on the support member fixture portion in the direction orthogonal to the front surface of the crankcase is transmitted to portions of the side wall portions 27$a$ (portions of the side wall portions 27$a$ that are present in the rib-reach regions) through the ribs 27$c$L, 27$c$R. The side wall portions 27$a$ are in contact with the front surface Pf of the crankcase 21, and extend in the direction orthogonal to the front surface Pf of the crankcase 21. Therefore, each side wall portion 27$a$ does not deform under the great force in the direction orthogonal to the front surface Pf of the crankcase 21 which is transmitted thereto through the ribs 27$c$L, 27$c$R, but transmits the force to the front surface Pf of the crankcase 21. In consequence, deformation of the crankcase-side chain case 27 (in particular, the front wall portion 27$b$) can be prevented.

Furthermore, the support member fixture portion 27$c$1 is disposed above the upper ends of the side wall portions 27$a$, and the first bolt-purpose seat surfaces (bolt holes BR1, BR2, BL1, BL2) are formed in portions of the side wall portions 27$a$ that extend from the rib-reach regions in the direction orthogonal to the front surface Pf of the crankcase 21 and that contact the front surface Pf of the crankcase 21. Therefore, the great force exerted on the support member fixture portion 27$c$1 in the direction orthogonal to the front surface Pf of the crankcase 21 is more reliably transmitted to the front surface Pf of the crankcase 21 by the ribs 27$c$L, 27$c$R, the side wall portions 27$a$ and the first bolts B1, B2. In consequence, deformation of the front wall portion 27$b$ of the crankcase-side chain case 27 can be more reliably prevented.

In addition, the second bolt-purpose seat surfaces (bolt holes BR3 to BR6, BL3 to BL6) are formed in other portions of the side wall portions 27$a$ that extend from the rib non-reach regions where the rib 27$c$L or 27$c$R does not reach the side wall portion 27$a$, in the direction orthogonal to the front surface Pf of the crankcase 21, and that contact the front surface Pf of the crankcase 21, and the diameter of the second bolts B3 to B6 used in the second bolt-purpose seat surfaces is smaller than the diameter of the first bolts B1, B2. Therefore, while the number of heavy-weight and large-diameter bolts (first bolts) is reduced, the rigidity, the fastening force and the like of the crankcase-side chain case 27 at the fastening sites between the crankcase-side chain case 27 and the crankcase 21 can be set at needed values, and the weight of the internal combustion engine can be reduced.

Incidentally, as for the length of the rib 27$c$2 measured from the upper end of the crankcase-side chain case 27 (i.e., the length of each of the leg portions 27$c$R, 27$c$L of the rib 27$c$2, which will be simply referred to as "rib leg length"), greater lengths are advantageous in various respects. This will be described hereinafter with reference to FIGS. 9A and 9B. FIG. 9A shows a instance where the rib leg length is relatively short. The rib leg length can be expressed by the distance L from the upper ends of the side wall portions 27$a$ to a point Q at which the rib disappears. In the crankcase-side chain case 27 shown in FIG. 9A, the distance L=L1.

In FIG. 9A, a downward force F1 is input to the crankcase-side chain case 27 via a support member. The force F1 is divided into a force F2 in a direction from a portion (point R) of contiguity between the support member fixture portion 27$c$1 and the rib 27$c$2 toward the point Q, and a force F3 in the direction orthogonal to the front surface Pf of the crankcase 21. The force F3 is a force that urges the upper end portion of the crankcase-side chain case 27 in a direction away from the front surface Pf of the crankcase 21. As a result, there is a possibility that an upper portion of the crankcase-side chain case 27 may deform as shown by a one-dot chain line, and that the sealing characteristic of the seal member 28$d$ may decline.

On the other hand, the rib 27$c$2 shown in FIG. 9B has relatively long legs. That is, the distance L=L2, and the distance L2 is longer than the distance L1. In this instance, the downward force F1 input to the crankcase-side chain case 27 via the support member is divided into a force F4 in a direction from the point R to the point Q, and a force F5 in the direction orthogonal to the front surface Pf of the crankcase 21. This force F5 is a force that urges an upper end portion of the crankcase-side chain case 27 in a direction away from the front surface Pf of the crankcase 21. However, as can be understood from the comparison between FIG. 9A and FIG. 9B, the force F5 is smaller than the force F3. Therefore, the greater the rib leg length, the less likely the upper portion of the crankcase-side chain case 27 is to deform.

If the distance L is long, the length of the rib-reach regions is also long, so that many bolt holes (bolt seat surfaces) can be formed in the flanges 27$a$1 present within the regions Ar shown in FIG. 8; thus, many bolt-fastened portions can be provided in portions where great force acts. This further improves the rigidity of the upper end portion of the crankcase-side chain case 27, and more thoroughly avoids deformation of the crankcase-side chain case 27.

Figure 10:
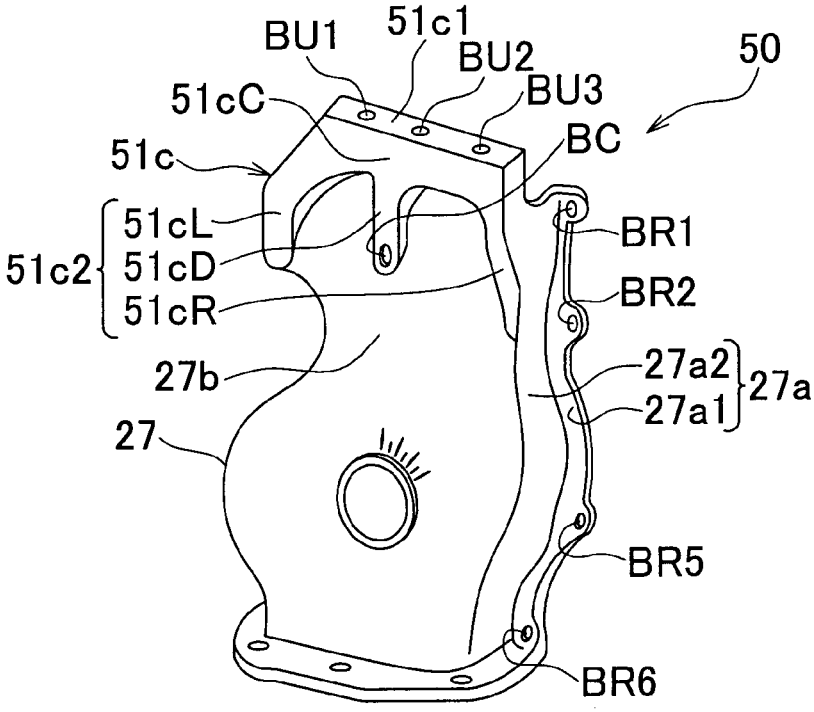
FIG. 10 is a perspective view of a crankcase-side chain case in accordance with a first modification in the invention.
Figure 11:
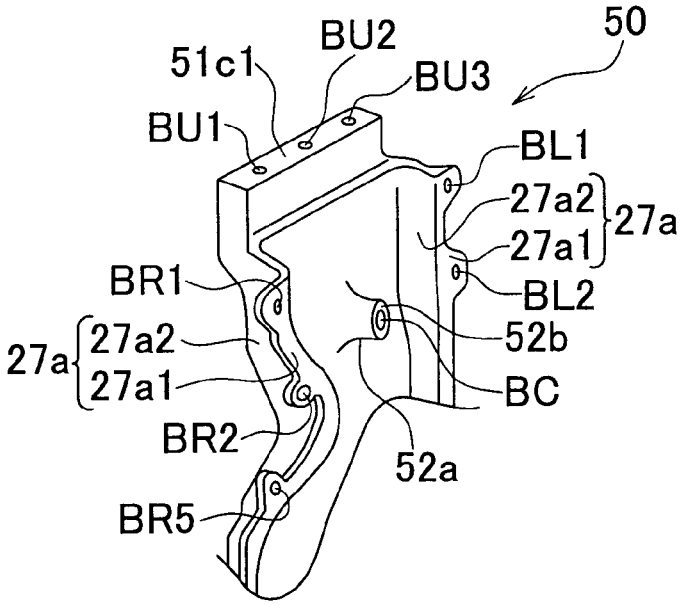
FIG. 11 is a perspective view of a portion of the crankcase-side chain case shown in FIG. 10 which is viewed from a reverse side thereof.

<FIRST MODIFICATION> Next, a first modification of the crankcase-side chain case in accordance with the invention will be described with reference to FIGS. 10 and 11. In FIGS. 10 and 11, substantially the same portions as those provided in the crankcase-side chain case 27 described above are represented by the same reference characters, and the description thereof will be omitted below.

A crankcase-side chain case 50 in accordance with this modification has a support member coupling portion 51$c$ instead of the support member coupling portion 27$c$ of the crankcase-side chain case 27, as shown in FIG. 10, which is an obverse surface side perspective view. The support member coupling portion 51$c$ includes a support member fixture portion 51$c$1 that is identical to the support member fixture portion 27$c$1, and a rib 51$c$2 instead of the rib 27$c$2.

The rib 51$c$2 includes a middle portion 51$c$C, a right-side leg portion 51$c$R and a left-side leg portion 51$c$L that are identical to the middle portion 27$c$C, the right-side leg portion 27$c$R and the left-side leg portion 27$c$L, respectively. Furthermore, the rib 51$c$2 also includes a middle downward extended portion 51$c$D that extends downward from a substantially middle portion of the middle portion 51$c$C with respect to the left-right direction (an intermediate portion between the leg portion 27$c$L and the leg portion 27$c$R). A lower end of the middle downward extended portion 51$c$D is extended to substantially the same position as lower ends of the right-side leg portion 51$c$R and the left-side leg portion 51$c$L (a position below an upper ends of side wall portions 27$a$), and is contiguous with a front wall portion 27$b$.

FIG. 11 is a perspective view of the crankcase-side chain case 50 viewed from the reverse surface side of the crankcase-side chain case 50. As shown in FIG. 11, the rib 51$c$2 includes an extended-out portion (protruded portion) 52$a$ that is extended out (protruded) from a site near a lower end portion of the middle downward extended portion 51$c$D, toward the front face of the crankcase. A distal end of the extended-out portion 52$a$ has a flat surface-shaped top portion 52$b$. The flat surface formed by the top portion 52$b$ is parallel to the front surface Pf of the crankcase 21 and is in contact with the front surface Pf of the crankcase 21 when the crankcase-side chain case 50 is fixed to the front surface Pf of the crankcase 21. The top portion 52$b$ has a bolt hole BC dedicated to a third bolt (therefore, a third bolt-purpose seat surface) that is provided for fixing the crankcase-side chain case 50 to the crankcase 21. The third bolt that uses the third bolt-purpose seat surface is equal in diameter to the aforementioned first bolts B1, B2. Incidentally, the extended-out portion 52*a* is provided at such a position as not to interfere with a chain mechanism (not shown).

The crankcase-side chain case 50 is bolted to the front surface Pf of the crankcase 21 by a plurality of bolts B1, B2, B5 and B6 inserted through bolt holes BR1, BR2, BR5 and BR6, respectively, which are formed in the flange 27*a*1 located on the right side of the crankcase-side chain case 27, and is also bolted to the front surface Pf of the crankcase 21 by a plurality of bolts B1, B2, B5 and B6 inserted through bolt holes BL1, BL2, BL5 and BL6, respectively, which are formed in the flange 27*a*1 located on the left side of the crankcase-side chain case 27. Incidentally, the bolt hole BR1 and the bolt hole BR2 are formed in a portion of the right-side flange 27*a*1 that is contiguous to a portion of the side walls 27*a*2 that extends from the aforementioned rib-reach region in the direction orthogonal to the front surface Pf of the crankcase 21. The bolt hole BL1 and the bolt hole BL2 (which are not shown) are formed at positions similarly determined on the left side of the crankcase-side chain case 50. Furthermore, the crankcase-side chain case 50 is bolted to the front surface Pf of the crankcase 21 by the third bolt inserted through the third bolt-purpose bolt hole BC that is formed in the top portion 52*b* of the extended-out portion 52*a*. The diameter of the third bolt is the same as the diameter of the first bolts (bolts B1, B2), and is larger than the diameter of the second bolts (B5, B6).

Therefore, a great component force exerted on the front wall portion 27*b* in the direction orthogonal to the front surface of the crankcase can be transmitted to front surface Pf of the crankcase 21 through the rib 51*c*2, the side wall portions 27*a*, and the extended-out portion 52*a* protruded from the rib 51*c*2. In consequence, deformation of the front wall portion 27*b* of the crankcase-side chain case 50 can be more reliably prevented.

Figure 12:
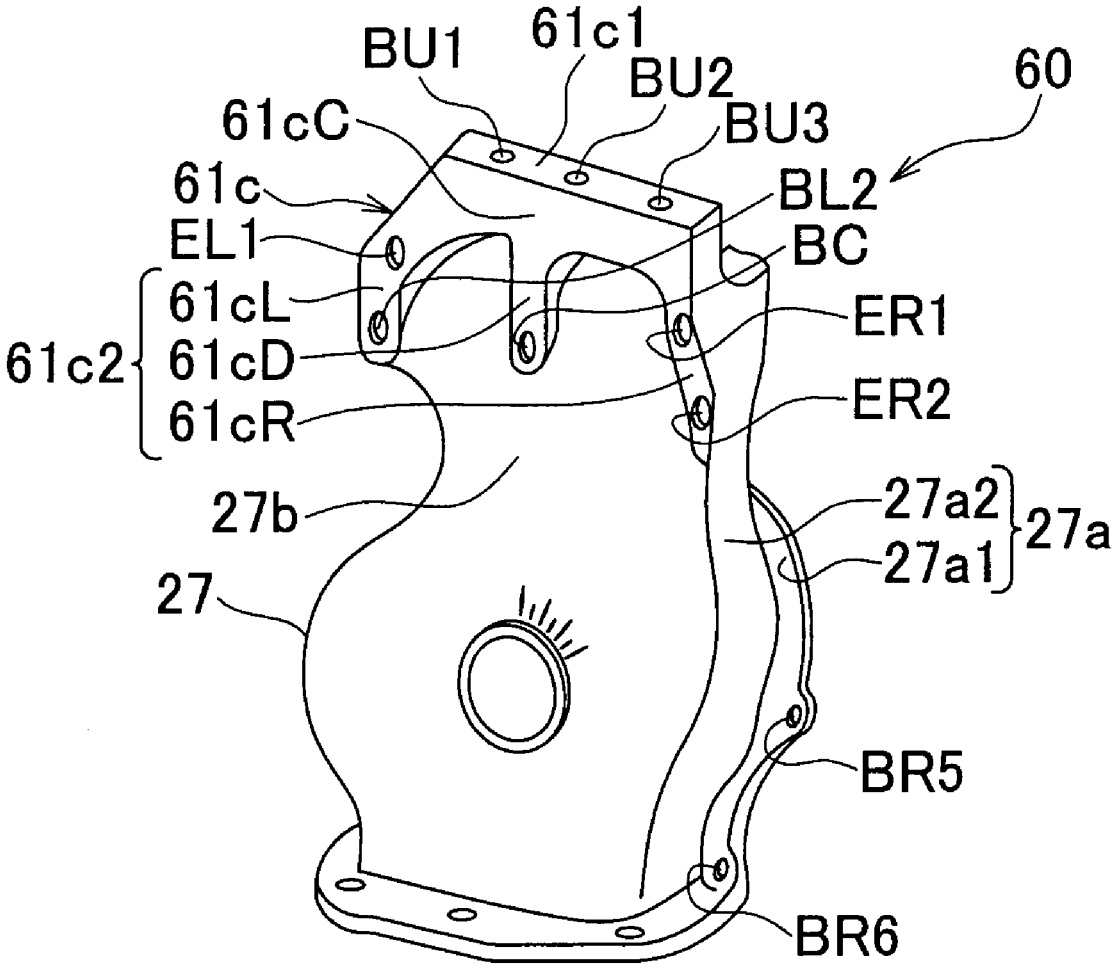
FIG. 12 is a perspective view of a crankcase-side chain case in accordance with a second modification in the invention.

<SECOND MODIFICATION> Next, a second modification of the crankcase in accordance with the invention will be described with reference to FIG. 12. In FIG. 12, substantially the same portions as those provided in the crankcase-side chain case 27 are represented by the same reference characters, and the description thereof will be omitted below.

A crankcase-side chain case 60 in accordance with the second modification includes a support member coupling portion 61*c* instead of the support member coupling portion 27*c* of the crankcase-side chain case 27. The support member coupling portion 61*c* includes a support member fixture portion 61*c*1 identical to the support member fixture portion 27*c*1, and a rib 61*c*2 instead of the rib 27*c*2.

The rib 61*c*2 includes a middle portion 61*c*C, a right-side leg portion 61*c*R, a left-side leg portion 61*c*L, and a middle downward extended portion 61*c*D. The middle portion 61*c*C and the middle downward extended portion 61*c*D are substantially the same as the middle portion 51*c*C and the middle downward extended portion 51*c*D of the first modification.

The right-side leg portion 61*c*R extends downward from a right end portion of the middle portion 61*c*C. A side surface of the right-side leg portion 61*c*R (that is the side surface on the same side as plane formed by a right-side side wall 27*a*2) is contiguous to the right-side side wall 27*a*2, and forms a right-side side wall of an upper portion of the crankcase-side chain case 60. The right-side leg portion 61*c*R extends out toward the front surface Pf of the crankcase 21, and contacts the front surface Pf of the crankcase 21. A contact portion of the right-side leg portion 61*c*R with the front surface Pf of the crankcase 21 has first bolt-purpose seat surfaces. The right-side leg portion 61*c*R has two bolt holes ER1, ER2 into which bolts that use the first bolt-purpose seat surfaces are inserted. The positions of the bolt holes ER1, ER2 with respect to the front surface Pf of the crankcase 21 are the same as the positions of the bolt holes BR1, BR2 with respect to the front surface Pf of the crankcase 21.

The left-side leg portion 61*c*L extends downward from a left end portion of the middle portion 61*c*C. A side surface of the left-side leg portion 61*c*L (that is the side surface on the same side as the plane formed by the left-side side wall 27*a*2) is contiguous to the left-side side wall 27*a*2, and forms a left-side side wall of an upper portion of the crankcase-side chain case 60. The left-side leg portion 61*c*L extends out toward the front surface Pf of the crankcase 21, and contacts the front surface Pf of the crankcase 21. A contact portion of the left-side leg portion 61*c*L with the front surface Pf of the crankcase 21 has a first bolt-purpose seat surface. The left-side leg portion 61*c*L as two bolt holes EL1, EL2 through which bolts that use the first bolt-purpose seat surfaces are inserted. The positions of the bolt holes EL1, EL2 with respect to the front surface Pf of the crankcase 21 are the same as the positions of the bolt holes BL1, BL2 with respect to the front surface Pf of the crankcase 21.

The crankcase-side chain case 60 is bolted to the front surface Pf of the crankcase 21 by second bolts inserted through the bolt holes BR5, BR6, BL5 and BL6 formed in the left and right flanges 27*a*1, and is also bolted to the front surface Pf of the crankcase 21 by a third bolt inserted through the third bolt-purpose bolt hole BC formed in an extended-out portion extending from the middle downward extended portion 61*c*D. Furthermore, the crankcase-side chain case 60 is bolted to the front surface Pf of the crankcase 21 by third bolts that use the first bolt-purpose seat surfaces and the bolt holes ER1, ER2 formed in the right-side leg portion 61*c*R, or the first bolt-purpose seat surfaces and the bolt holes EL1, EL2 formed in the left-side leg portion 61*c*L.

According to this modification, the right-side leg portion 61*c*R and the left-side leg portion 61*c*L of the rib 62*c*2 constitute portions of the side wall portions of the crankcase-side chain case 60, and the leg portions 61*c*R, 61*c*L are bolted to the front surface Pf of the crankcase 21, at portions of the leg portions 61*c*R, 61*c*L that are in contact with the front surface Pf of the crankcase 21. Therefore, great component force that would act on the front wall portion 27*b* in the direction orthogonal to the front surface of the crankcase can be transmitted directly to the front surface Pf of the crankcase 21 through the right-side leg portion 61*c*R and the left-side leg portion 61*c*L of the rib 62*c*2. In consequence, deformation of the front wall portion 27*b* of the crankcase-side chain case 60 can be more reliably prevented.

As described above, the drive device 10 in accordance with the embodiments of the invention can make it possible to appropriately mount the internal combustion engine 20 in the vehicle body, and can prevent various faults caused by deformation of the divided chain case 26. Incidentally, the invention is not limited to the foregoing embodiments, but various modifications may be adopted within the scope of the invention.

What is claimed is:

1. A drive device mounted in a vehicle body, comprising:

a transmission device;

a variable compression ratio internal combustion engine that includes a crankcase that rotatably supports a crankshaft coupled to the transmission device, and a cylinder block disposed above the crankcase, and that is capable of changing a compression ratio by moving the cylinder block relative to the crankcase in a cylinder axis direction;

a support member whose portion is supported on the vehicle body in order to support the drive device on the vehicle body;

a cylinder block-side chain case fixed to the cylinder block so as to cover a front surface of the cylinder block that is a surface opposite from a side of the cylinder block where the transmission device is disposed; and a crankcase-side chain case which is fixed to the crankcase so as to cover a front surface of the crankcase that is a surface opposite from a side of the crankcase where the transmission device disposed, and which has a support member coupling portion that couples to another portion of the support member.

2. The drive device according to claim 1, wherein the crankcase-side chain case has:

a side wall portion that contacts a vicinity of a left-side end portion of the front surface of the crankcase and a vicinity of a right-side end portion of the front surface of the crankcase and that extends in a direction orthogonal to the front surface of the crankcase; and a front wall portion that is contiguous to the side wall portion and that faces the front surface of the crankcase, and wherein the support member coupling portion includes a support member fixture portion which another portion of the support member is in contact with and is fixed to, and which forms an upper wall of the support member coupling portion, and a rib that extends from the support member fixture portion and that is contiguous to the front wall portion so as to improve a rigidity of the front wall portion.

3. The drive device according to claim 2, wherein the rib is formed so as to extend from the support member fixture portion to a portion of the side wall portion.

4. The drive device according to claim 3, wherein a first bolt-purpose seat surface for fixing the crankcase-side chain case and the crankcase to each other is formed in a portion of the side wall portion that extends from a rib-reach region that is a region in the side wall portion in which the rib reaches the side wall portion, in the direction orthogonal to the front surface of the crankcase, and that contacts the front surface of the crankcase.

5. The drive device according to claim 4, wherein a second bolt-purpose seat surface for fixing the crankcase-side chain case and the crankcase to each other is formed in another portion of the side wall portion that extends from a rib non-reach region that is another region in the side wall portion in which the rib does not reach the side wall portion, in the direction orthogonal to the front surface of the crankcase, and a diameter of a second bolt that uses the second bolt-purpose seat surface is smaller than a diameter of a first bolt that uses the first bolt-purpose seat surface.

6. The drive device according to claim 5, wherein at least a portion of the rib includes an extended-out portion that is extended out so as to contact the front surface of the crankcase, and a third bolt-purpose seat surface for fixing the crankcase-side chain case and the crankcase to each other is formed in the extended-out portion.

7. The drive device according to claim 6, wherein a diameter of a third bolt that uses the third bolt-purpose seat surface is larger than a diameter of the second bolt that uses the second bolt-purpose seat surface.

8. The drive device according to claim 2, wherein at least a portion of the rib includes an extended-out portion that is extended out so as to contact the front surface of the crankcase, and a third bolt-purpose seat surface for fixing the crankcase-side chain case and the crankcase to each other is formed in the extended-out portion.

9. The drive device according to claim 2, wherein the portion of the support member that is supported on the vehicle body is supported on the vehicle body at a first position that is above an upper end of the crankcase, and the transmission device is supported on the vehicle body at a second position, and the first position is set at such a position that a center of gravity of a structure body of the drive device that excludes a structure body that moves together with the cylinder block when the compression ratio is changed is below a straight line that connects the first position and the second position.

10. The drive device according to claim 3, wherein at least a portion of the rib includes an extended-out portion that is extended out so as to contact the front surface of the crankcase, and a third bolt-purpose seat surface for fixing the crankcase-side chain case and the crankcase to each other is formed in the extended-out portion.

11. The drive device according to claim 3, wherein the portion of the support member that is supported on the vehicle body is supported on the vehicle body at a first position that is above an upper end of the crankcase, and the transmission device is supported on the vehicle body at a second position, and the first position is set at such a position that a center of gravity of a structure body of the drive device that excludes a structure body that moves together with the cylinder block when the compression ratio is changed is below a straight line that connects the first position and the second position.

12. The drive device according to claim 4, wherein at least a portion of the rib includes an extended-out portion that is extended out so as to contact the front surface of the crankcase, and a third bolt-purpose seat surface for fixing the crankcase-side chain case and the crankcase to each other is formed in the extended-out portion.

13. The drive device according to claim 1, wherein the portion of the support member that is supported on the vehicle body is supported on the vehicle body at a first position that is above an upper end of the crankcase, and the transmission device is supported on the vehicle body at a second position, and the first position is set at such a position that a center of gravity of a structure body of the drive device that excludes a structure body that moves together with the cylinder block when the compression ratio is changed is below a straight line that connects the first position and the second position.

14. The drive device according to claim 13, wherein the straight line that connects the first position and the second position is set so as to form a principal axis of inertia of the drive device.

* * * * *